US006481243B1

(12) United States Patent
Fang et al.

(10) Patent No.: US 6,481,243 B1
(45) Date of Patent: Nov. 19, 2002

(54) PRESSURE ACCUMULATOR AT HIGH PRESSURE SIDE AND WASTE HEAT RE-USE DEVICE FOR VAPOR COMPRESSED AIR CONDITIONING OR REFRIGERATION EQUIPMENT

(76) Inventors: Wei Fang, 3F, No. 50, Lane 2, Section 6, Chung-Shan No. Rd., Taipei (TW); Way-Jone Hsiao, 5F, No. 75-1, Kang-Hua St., Nei-Hu District, Taipei (TW)

( * ) Notice: Subject to any disclaimer, the term of this patent is extended or adjusted under 35 U.S.C. 154(b) by 0 days.

(21) Appl. No.: 09/824,392

(22) Filed: Apr. 2, 2001

(51) Int. Cl.[7] ..... F25B 41/00
(52) U.S. Cl. ..... 62/513; 62/498
(58) Field of Search ..... 62/513, 498, 468, 62/473

(56) References Cited

U.S. PATENT DOCUMENTS 3,596,474 A * 8/1971 Bloxham
4,030,315 A * 6/1977 Harnish ..... 62/513 X
4,059,968 A * 11/1977 Ross
4,179,898 A * 12/1979 Vakil
4,209,997 A * 7/1980 Hodits, Jr. et al.
4,217,760 A * 8/1980 Vakil et al.
4,227,905 A * 10/1980 Burger et al. ..... 62/513 X
4,718,250 A * 1/1988 Warren ..... 62/513 X
4,735,054 A * 4/1988 Beckey
5,243,837 A * 9/1993 Radermacher et al. ..... 62/513
5,245,833 A * 9/1993 Mei et al. ..... 62/513 X
5,491,981 A * 2/1996 Kim ..... 62/513 X
5,511,384 A * 4/1996 Likitcheva
5,619,865 A 4/1997 Maxwell ..... 62/513 X
5,737,929 A 4/1998 Siosteen et al.
5,784,892 A 7/1998 Reedy
5,899,091 A 5/1999 Fraser, Jr. et al. ..... 62/473
6,058,727 A 5/2000 Fraser, Jr. et al. ..... 62/473 X

* cited by examiner

*Primary Examiner*—Chen-Wen Jiang
(74) *Attorney, Agent, or Firm*—Bucknam & Archer

(57) ABSTRACT

A vapor compressed air conditioning or refrigeration equipment includes an accumulator connected between the high pressure side of the compressor and, the inlet of the condenser; a flow-rate control unit is provided at the outlet of the accumulator. Also provided is a dipped type heat exchanger device disposed at the high pressure side of the compressor and connected between the compressor and the condenser via refrigerant pipes and a submersible heat dissipated tube. The dipped type heat exchanger includes a container for storing a heat transfer medium for heat exchange with a waste heat recycled tube combined with the container in heat transfer relationship. The tube is disposed between the low-pressure side of the air conditioning equipment and the compressor, for the purpose of reducing the temperature of the heat transfer medium and thus reducing the temperature of the high temperature superheated refrigerant vapor within the submersible heat dissipated tube.

8 Claims, 4 Drawing Sheets

PRESSURE ACCUMULATOR AT HIGH PRESSURE SIDE AND WASTE HEAT RE-USE DEVICE FOR VAPOR COMPRESSED AIR CONDITIONING OR REFRIGERATION EQUIPMENT

BACKGROUND OF THE INVENTION

This invention relates to a pressure accumulator at high pressure side and waste heat re-use device for vapor compressed air conditioning or refrigeration equipment, by which a pressure and a temperature, higher than a conventional device, for refrigerant at high pressure side can be maintained so as to increase the rate of heat dissipation and heat absorption capacity, and accordingly the energy efficiency ratio (EER).

Referring to FIG. 1, a fundamental structure of a conventional vapor compressed air conditioning and refrigeration equipment is shown. A liquid separator 1 is connected via a refrigerant pipe 3 to a compressor 2 such that the saturated refrigerant vapor is suctioned into the compressor 2 and compressed therein. Refrigerant vapor compressed by said compressor 2 will reach superheated state, and enter into a condenser 5, so-called condenser or heat dissipater, via a refrigerant pipe 4. Said condenser 5 comprises a plurality of fins and tubes 6 looped there within. Air is introduced into said condenser 5 for the heat dissipation of high temperature superheated refrigerant gas within condenser tubes, by the rotation of blades 7 of one or more sets of propeller fan 8 for heat dissipation fixed on a frame 9.

Superheated refrigerant gas within condenser tubes will transform into saturated gas, then gas and liquid co-existed then saturated liquid phase after energy reduction through heat exchange with outside air. Since the saturated temperature, i.e. the refrigerant boiling temperature under pipe pressure within condenser is higher than the temperature of outside air, the enthalpy of refrigerant can be reduced by the heat dissipation through outside air, which will result in the liquidization of refrigerant vapor. The liquid-vapor ratio is thus increased. The liquid-vapor ratio will reach its maximum at the outlet of said condenser 5. After the end of heat dissipation, the saturated refrigerant liquid will enter into a throttling valve 10 via a refrigerant pipe 11 to conduct an equal-enthalpy expansion process within said throttling valve. The pressure as well as temperature of the refrigerant will become lower after the expansion process. In this case, the saturated refrigerant under the lowering of saturated temperature and low pressure condition is enter into a heat absorptive tube-and-fin assembly 13, so-called evaporator. Since the phase change from liquid to gas of the refrigerant, an equal-pressure (isobaric) process, is in need of latent heat, the heat contained in the room air, at higher-temperature, can be absorbed such that the temperature of the room can be reduced. Then, saturated refrigerant with lower liquid-vapor ratio is sent back to said liquid separator 1 via the collection of a refrigerant pipe 14. Finally, the gas refrigerant is return to the compressor 2 via the refrigerant pipe 3, to complete a closed refrigerantion cycle for the air conditioning or refrigeration equipment. In a conventional technique as shown in FIG. 2, a fundamental structure of vapor compressed air conditioning or refrigeration equipment with a two-stage heat dissipation is shown. A liquid separator 15 is connected via a refrigerant pipe 17 to a compressor 16 such that the saturated refrigerant vapor is suctioned into the compressor 16 and compressed therein. Refrigerant vapor compressed by said compressor 16 will reach superheated state, and enter into a first condenser 19 via a refrigerant pipe 18. Said first condenser 19 comprises a plurality of fins and tubes 20 looped there within. Air is suctioned into said first condenser 19 for the heat dissipation of superheated refrigerant gas within condenser tubes, by the rotation of blades 21 of one or more sets of propeller fan 22 for heat dissipation fixed on a frame 23. Superheated refrigerant gas within said first condenser 19 will transform into saturated phase after energy reduction through heat exchange with outside air. In this case, the refrigerant is at a state with its gas and liquid phase co-existed. Since the saturated temperature, i.e. the refrigerant boiling temperature under pipe pressure is still higher than the temperature of outside air, the enthalpy of refrigerant can still be reduced by the heat dissipation through outside air, which will result in the liquidization of refrigerant vapor. The liquid-vapor ratio is thus increased. The liquid-vapor ratio will reach its maximum value of first stage of heat dissipation at the outlet of said first condenser 19. After the end of heat dissipation, the high liquid-vapor ratio refrigerant will enter into a second condenser 25 via a refrigerant pipe 24. Said second condenser 25 comprises a plurality of fins and tubes 26 looped there within. Air is suctioned into said second condenser 25 for the heat dissipation of saturated refrigerant at higher temperature within condenser tubes 26, by the rotation of a fan 27, for heat dissipation, driven by one or more sets of high-speed motors 28 mounted on a frame 29. Saturated liquid or sub-cooled refrigerant at the outlet of second condenser 25 can be assured. Subsequently, the refrigerant liquid will enter into a throttling valve 31 via a refrigerant pipe 30 to conduct an equal-enthalpy expansion process within said throttling valve. The pressure and temperature of the refrigerant will decrease after the expansion process. In this case, the saturated refrigerant under the lower saturated temperature and low pressure condition enter the evaporator 32. Since the phase change from liquid to gas of the refrigerant, an isobaric process, is in need of latent heat, the heat contained in the room air can be absorbed such that the temperature of the room can be reduced. Then, saturated refrigerant with lower liquid-vapor ratio is sent back to said liquid separator 15 via the collection of a refrigerant pipe 33. Finally, the gas refrigerant is return to the compressor 16 via the refrigerant pipe 17, to complete a closed refrigerantion cycle for the air conditioning or refrigeration equipment with a two-stage heat dissipation.

In the fundamental structure of a conventional vapor compressed air conditioning and refrigeration equipment as shown in FIG. 1, since the refrigerant, being introduced directly into the condenser tubes 6 of said first condenser 5 after passing through compressor 2, and being heat-dissipated by the air suctioned into said first condenser 5 by the rotation of blades 7 of one or more sets of fan 8 for heat dissipation, transforms from gas at high temperature and high pressure superheated state into saturated refrigerant with its gas and liquid co-existed at lower temperature and lower pressure. The heat dissipation efficiency deteriorates due to the reduction of temperature difference which will result in the reduction of temperature gradient. This will cause the liquid-vapor ratio of saturated refrigerant being unable to be raised further to a higher level at the outlet of first condenser 5. This is the reason why the EER value of a conventional vapor compressed air conditioning and refrigeration equipment can not be improved.

The difference of two conventional vapor compressed air conditioning or refrigeration equipment as shown in FIGS. 1 and 2 is the use of a two-stage heat dissipation method, i.e. a two-stage heat dissipation device including a heat dissipated first condenser 19 and a second condenser 25 as shown in FIG. 2. In order to have better heat dissipation and to ensure the increase of liquid-vapor ratio of saturated refrigerant, a first condenser 19 is used to dissipate the heat of superheated refrigerant gas and a secondary condenser is used to dissipate the heat of saturated refrigerant. The heat was removed by the air introduced into said both condensers. Then, the refrigerant is circulated back to liquid separator 15 via refrigerant pipe 30,throttling valve 31, evaporator 32 and refrigerant pipe 33. In this design, more heat can be removed at high pressure side of the refrigerant cycle, thus leading to a higher cooling effect. However, additional condenser, high-speed motors and fans for heat dissipation have to be provided which will result in higher initial cost and operating cost.

It is worthwhile to develop another method for the improvement of efficiency of heat dissipation and EER with less cost.

SUMMARY OF THE INVENTION

It is the object of present invention to provide a pressure accumulator at high pressure side and waste heat re-use device for vapor compressed air conditioning or refrigeration equipment, wherein superheated refrigerant vapor after the compression by compressor is introduced into said pressure accumulator for the maintaining of pressure of high pressure side. Furthermore, under a system pressure higher than conventional device for superheated refrigerant vapor, heat dissipation is carried out at higher air quantity and higher temperature difference. In addition, the efficiency of heat dissipation can be increased due to the higher pressure of saturated refrigerant. The sub-cool state of refrigerant can be attained after a substantial removal of heat through condenser.

The above object of present invention can be obtained by the provision of a pressure accumulator at high pressure side for vapor compressed air conditioning or refrigeration equipment, wherein one end of said pressure accumulator is connected to the discharge end of a compressor via a refrigerant pipe; the other end of said pressure accumulator being connected to a input end of a condenser via a refrigerant pipe with a smaller diameter than above-mentioned pipe. The refrigerant compressed by compressor becomes superheated vapor with high temperature and high pressure, and enters into said pressure accumulator via a refrigerant pipe connected between compressor and accumulator. In this case, the pressure loss will not be so apparent due to the few heat dissipation and temperature reduction. There is a flow-rate control device provided within the condenser tube of said condenser for the regulation of refrigerant flow such that the pressure within condenser tube, after the refrigerant entering from said pressure accumulator, will not be reduced too much in view of heat dissipation. Air is introduced at higher velocity to the condenser for the heat dissipation of refrigerant gas within condenser tubes, by the rotation of a high-speed fan fixed on a frame. As the refrigerant is influenced by the accumulated pressure within the pressure accumulator, the pressure drop within condenser tubes will not be so significant. The heat dissipation of refrigerant can be conducted at higher temperature and higher pressure. Under the same outside air temperature condition, a substantial amount of heat of refrigerant can be removed due to the temperature difference between air temperature and refrigerant temperature being larger than that of conventional, and due to the larger quantity and of air faster velocity being provide by a fan than that of a conventional propeller fan.

Furthermore, the refrigerant before entering the condenser, and after leaving evaporator can be conducted an exchange within liquid dipping type heat exchanger. Thereby, waste heat can be re-used for the later, and further heat can be dissipated for the former such that the refrigerant can be vaporized almost (or completely) before entering (return to) the inlet of compressor.

Therefore, this invention can assure the improvement of efficiency of heat dissipation and the increasing of cooling capacity as well as EER value.

BRIEF DESCRIPTION OF THE DRAWINGS

The objects, advantages and characteristics of present invention will become more apparent by the detailed description of embodiments of this invention with reference to the accompanied drawings, in which.

DETAILED DESCRIPTION OF A PREFERRED EMBODIMENT OF PRESENT INVENTION

Figure 1:
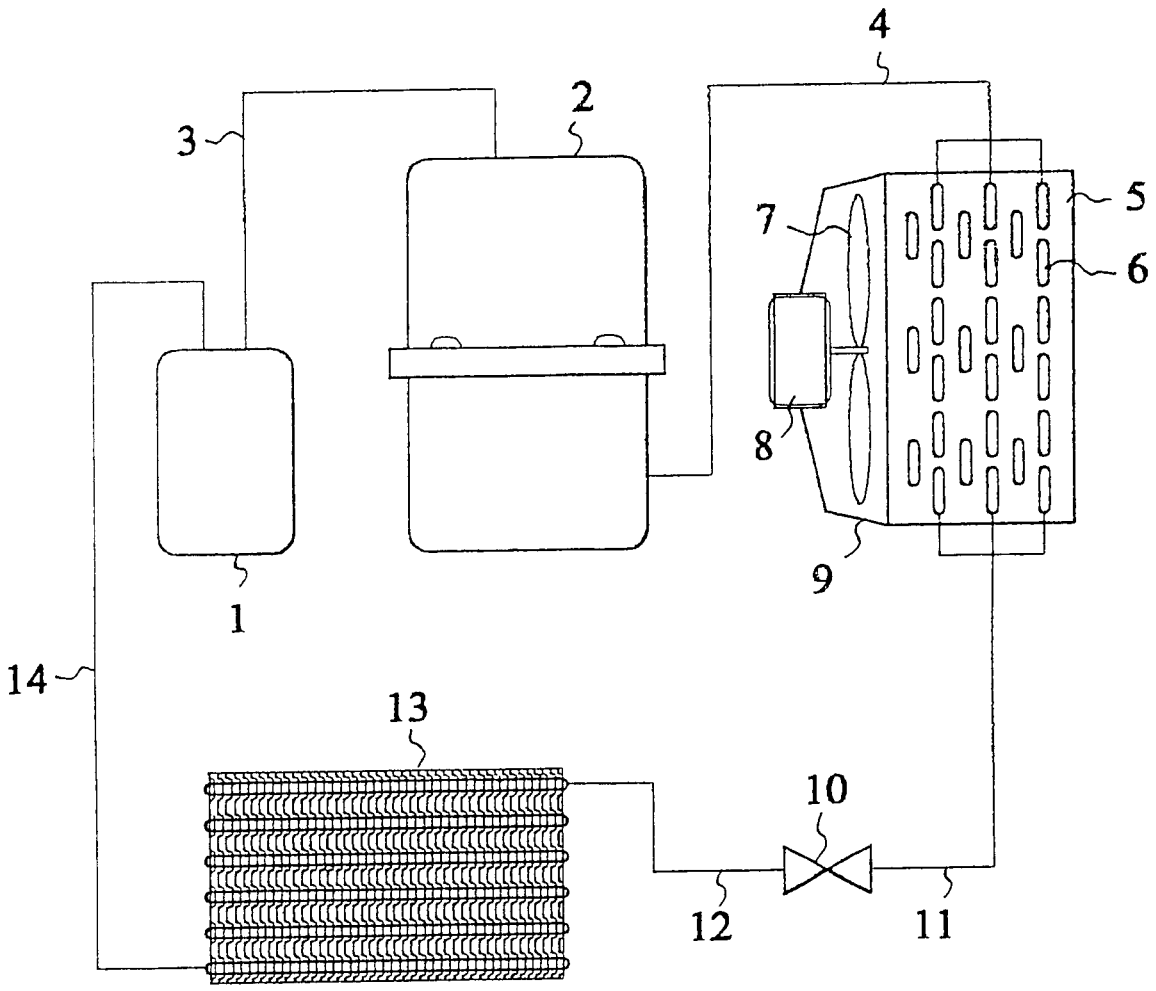
( PRIOR ART ) FIG 1
FIG. 1 is a schematic view showing a conventional vapor compressed air conditioning or refrigeration equipment.
Figure 2:
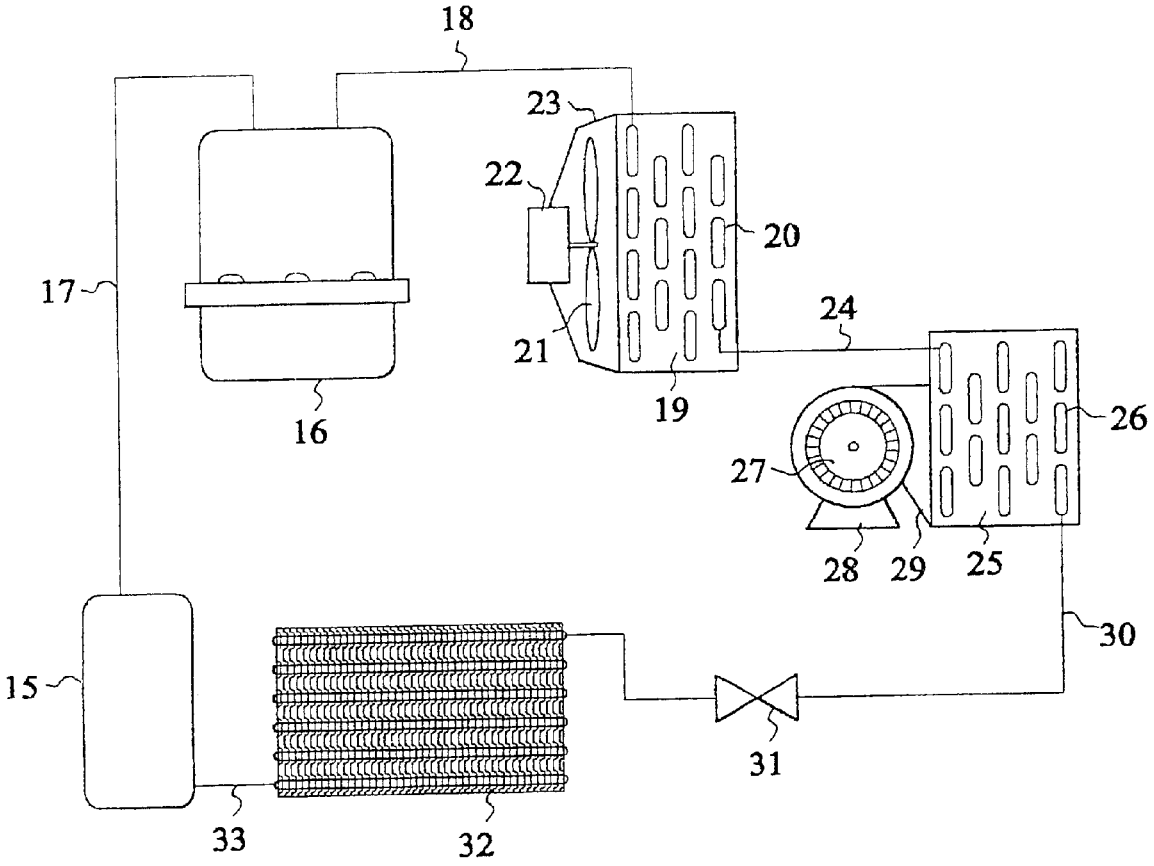
( PRIOR ART ) FIG 2
FIG. 2 is a schematic view showing a conventional vapor compressed air conditioning and refrigeration equipment with a 2-stage of heat dissipation unit.
Figure 3:
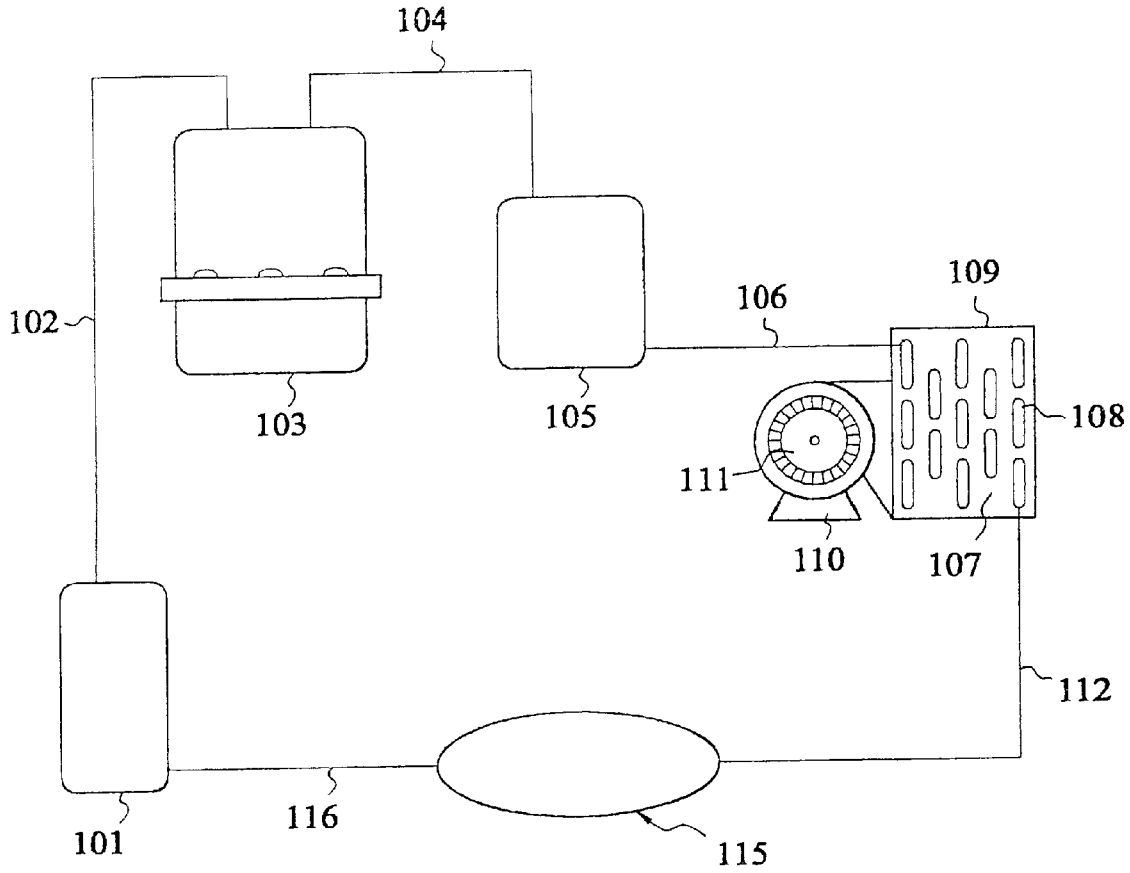
FIG. 3 is a schematic view showing one embodiment of pressure accumulator device of present invention individually used in a vapor compressed air conditioning or refrigeration equipment.

Firstly, referring to FIG. 3, wherein reference 101 represents a liquid separator which is connected to inlet end of compressor 103 via a refrigerant pipe 102, and to a low-pressure side 115 of a vapor compressed air conditioning and refrigeration equipment via another refrigerant pipe 116. The low-pressure side 115 at least comprises a throttling valve 10 as shown in FIG. 1, refrigerant pipe 12 and evaporator 13. This invention does not involve any change concerning these elements, and therefore refers these parts as low-pressure side 115. Saturated refrigerant with low pressure and low temperature passing through low-pressure side 115 of vapor compressed air conditioning or refrigeration equipment enters liquid separator 101 via refrigerant pipe 116 in a complete gas state so as to avoid incompressible liquid refrigerant from entering into the compressor to damage the compressor by overloading. The characteristics of present invention is that a pressure accumulator 105 is provided, with its input end connected to compressor 103 via a refrigerant pipe 104 and output end to a condenser 107 via a refrigerant pipe 106. The condenser 107 consists of a frame 109, a condenser tube 108 and a plurality of fins. A high-speed motor 110 is provided at one side of the condenser 107, for driving a blower 111 for the condenser 107. A refrigerant pipe 112 is connected with one end to the condenser 107 and the other end to the low-pressure side 115 of vapor compressed air conditioning or refrigeration equipment. A refrigerant flow-rate control unit (not shown in the figures), such as pressure type flow-rate control valve can be provided at the junction of pressure accumulator 105 and refrigerant pipe 106, or within the condenser tubes of the condenser 107 or outside the condenser tubes of the condenser 107 for a purpose to regulate the pressure within the pipe. This will lead the high pressure to be kept at a stable state. The refrigerant pipes at the inlet and outlet ends respectively of the pressure accumulator 105 can have diameters different with each other. In case that the diameter of the refrigerant pipe 106 at the outlet end is smaller than that of the refrigerant pipe 104 at the inlet end, the high pressure side during heat dissipation can be maintained at a higher pressure and higher temperature than that of prior art.

Figure 4:
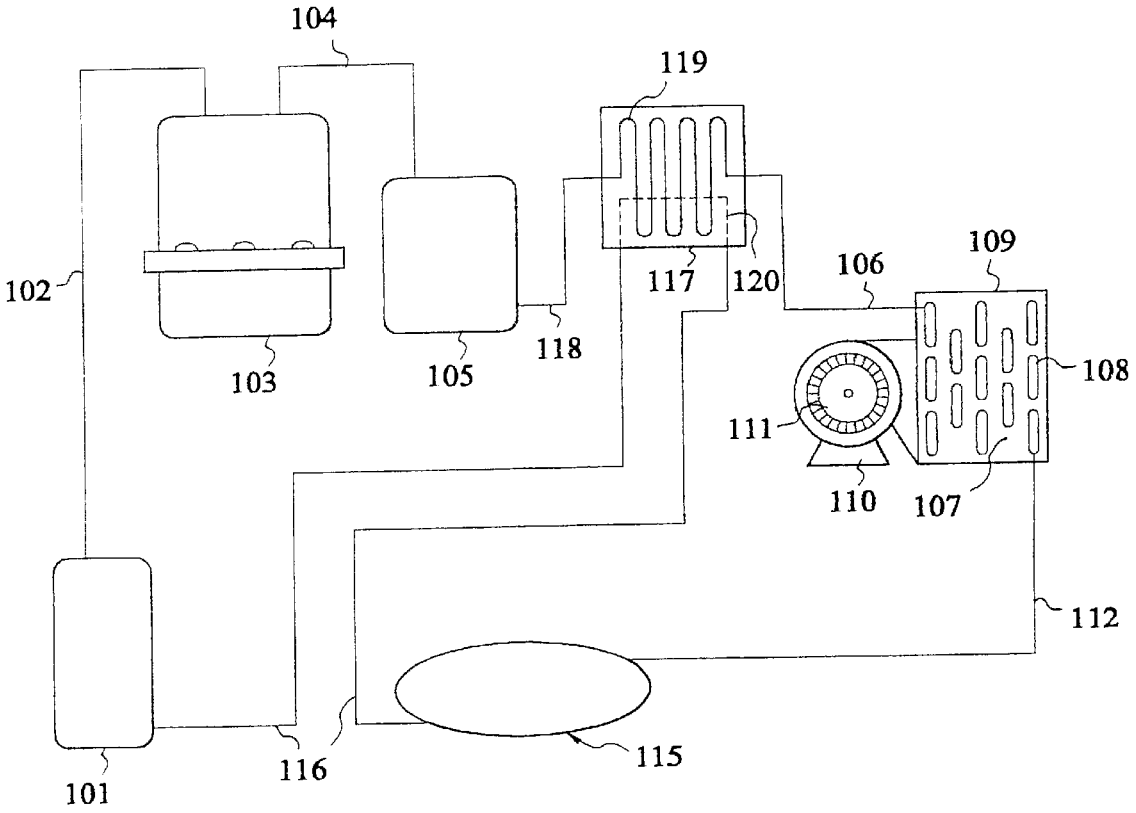
FIG. 4 is a schematic view showing one embodiment of a conventional vapor compressed air conditioning or refrigeration equipment with pressure accumulator and waste heat re-use device of present invention.

Next, referring to FIG. 4, wherein components with similar function as in FIG. 3 is represented with the same reference. Reference 101 represents a liquid separator which is connected to inlet end of compressor 103 via a refrigerant pipe 102, and to a low-pressure side 115 of a vapor compressed air conditioning or refrigeration equipment via another refrigerant pipe 116. Saturated refrigerant with low pressure and low temperature passing through low-pressure side 115 of vapor compressed air conditioning or refrigeration equipment is introduced into a dipped type heat exchanger 117 before entering liquid separator 101 via refrigerant pipe 116, such that the refrigerant can be at saturated or superheated gas state by the utilization of part of waste heat from the superheated refrigerant vapor within the pressure accumulator 105. Thus, incompressible liquid refrigerant is prevented from entering into the compressor to damage the compressor by overloading. Part of the refrigerant pipe 116 is disposed within the dipped type heat exchanger 117 and is referred to as waste heat recycled pipe 120. As shown in FIG. 3, the aforementioned pressure accumulator 105 which is connected to compressor 103 via a refrigerant pipe 104 is connected to the submersible heat dissipated tubes 119 of dipped type heat exchanger 117 via refrigerant pipe 118. The submersible heat dissipated tubes 119 conducts heat exchange with waste heat recycled pipe 120 within heat exchanger 117 by heat transfer medium (not shown in figures). The heat transfer medium can be selected from condensed water from evaporator of a certain type air conditioner or refrigerator, rain water or tap water etc. The submersible heat dissipated tubes 119 of dipped type heat exchanger 117 is connected to the condenser 107 via refrigerant pipe 106. The condenser 107 consists of a frame 109, a heat dissipated tube 108 and a plurality of fins. A high-speed motor 110 is provided at one side of the condenser 107, for driving a blower 111 for the condenser 107. The outlet end of the condenser 107 is connected to the low-pressure side 115 of vapor compressed air conditioning or refrigeration equipment via refrigerant pipe 112. A refrigerant flow-rate control unit (not shown in the figures), such as pressure type flow-rate control valve can be provided in refrigerant pipe 118 or 106, or within the condenser tubes 108 of the condenser 107 for a purpose to regulate the pressure within the pipe. This will lead the high pressure to be kept at a stable state.

Based on foregoing, the advantages resulted from the utilization of pressure accumulator and waste-heat re-use device of present invention can be listed as below:

(1). High pressure generated by compressor 103 can be accumulated by the combination of pressure accumulator 105 of this invention and flow-rate control unit in such a manner that superheated refrigerant vapor can conduct heat dissipation at condenser with less pressure lost. In an ideal cycle, this is an isobaric process, but never happened in the real world situation. In view of the pressure accumulation of high pressure, superheated refrigerant vapor of an air conditioner or refrigerator which is provided with a pressure accumulator will be closer to high temperature and high pressure state of compressor outlet than that without a pressure accumulator. Thus, the temperature difference between condenser tubes of condenser and outside air will increase so that much more heat will be dissipated under similar air speed and outside air temperature conditions.

(2). After heat dissipation by dipped type heat exchanger and condenser, superheated refrigerant vapor can become saturated under temperature and pressure which is higher than that of prior art. Not only the vapor pressure can be maintained, but also the liquid refrigerant pressure can be higher than that in a conventional air conditioner or refrigerator. The liquid-vapor ratio of saturated refrigerant can be raised step by step under low pressure drop condition. The refrigerant passing through condenser can reach saturated or sub-cooled state under limited pressure drop condition.

(3). The refrigerant from low-pressure side 115 enters into waste heat recycled pipe of dipped type heat exchanger to absorb much more heat in such a manner that the residual liquid refrigerant entering into the liquid separator is much less than a conventional device. Moreover, the refrigerant can be completely vaporized so that the work done by compressor onto the refrigerant can be reach optimum status. In the mean time, the energy of superheated refrigerant vapor passing through pressure accumulator can be further reduced by the condensed water from evaporator or another cooling liquid entering into heat exchanger device. Therefore, the energy of refrigerant can be reduced quickly by further cooling through aforementioned heat exchanger. By substantial amount of heat dissipation under limited pressure drop condition, refrigerant can transform from superheated state into saturated state.

(4). The refrigerant output end of condenser is disposed adjacent to blower fan side so as to allow the temperature of refrigerant at the output end being close to outside air temperature. Thereby, best efficiency of heat dissipation can be obtained. The temperature of air introduced can be increased gradually by the gradual absorption of heat. Since the refrigerant temperature of upper part is higher than that of lower part, the air introduced is still able to absorb the refrigerant heat of condenser tubes at upper side, so as to realize the purpose of sufficient heat dissipation.

In this way, the purpose of energy saving can be achieved by a closed refrigerant system of air conditioner or refrigerator in this invention, wherein the high side pressure as well as the low side pressure can be maintained higher than that of prior art so that the refrigeration efficiency as a whole can be increased. Accordingly, not only the cooling effect can be improved, but also the EER value is enhanced significantly.

While this invention illustrated and described is according to a representative embodiment of this invention only, it should not considered as a limitation. Any modifications as well as variations without departing from the spirit and scope of this invention, which is clearly defined by the appended Claims, are still within the range of this invention.

LIST OF MAIN COMPONENTS OF THIS INVENTION

1—liquid separator
2—compressor
3—refrigerant pipe
4—refrigerant pipe
5—condenser
6—tube

7—blade
8—propeller fan
9—frame
10—valve
11—refrigerant pipe
13—tube-and-fin assembly
14—refrigerant pipe
15—liquid separator
16—compressor
17—refrigerant pipe
18—refrigerant pipe
19—first condenser
20—tube
21—blade
22—propeller fan
23—frame
24—refrigerant pipe
25—second condenser
26—tube
27—fan
28—high-speed motor
29—frame
30—refrigerant pipe
31—throttling valve
32—evaporator
33—refrigerant pipe
101—liquid separator
102—refrigerant pipe at low pressure side
103—compressor
104—refrigerant pipe at high pressure side
105—pressure accumulator
106—refrigerant pipe at inlet end of condenser
107—condenser
108—condenser tube
109—frame
110—high-speed motor
111—blower fan
112—refrigerant pipe at outlet end of condenser
115—low-pressure side
116—refrigerant pipe at outlet end of low-pressure side
117—dipped type heat exchanger
118—refrigerant pipe at outlet end of pressure accumulator
119—submersible heat dissipated tube
120—waste heat recycled tube

What is claimed is:

1. In a vapor compressed air conditioning or refrigeration equipment including a compressor, a condenser, a throttling valve, and an evaporator, the improvement comprising:

a waste heat re-use device comprising a dipped type heat exchanger device disposed at a high pressure side of said compressor and connected between said compressor and said condenser via refrigerant pipes and including a submersible heat dissipated tube in said heat exchanger device through which passes high temperature superheated refrigerant vapor, said dipped type heat exchanger device including a container for storing a heat transfer medium for heat exchange; and a waste heat recycled tube connected in heat transfer relationship to said container, said waste heat recycled tube being disposed between a low pressure side of the air conditioning or refrigeration equipment and said compressor for reducing the energy of said heat transfer medium and, in turn, reducing the energy of said high temperature super-heated refrigerant vapor within said submersible heat dissipated tube by the utilization of recycled low temperature saturated refrigerant.

2. The vapor compressed air conditioning or refrigeration equipment in accordance with claim 1, wherein said heat transfer medium in said dipped type heat exchanger is water.

3. The vapor compressed air conditioning or refrigeration equipment in accordance with claim 2, wherein said water is condensed water of said air conditioning or refrigeration equipment.

4. The vapor compressed air conditioning or refrigeration equipment in accordance with claim 1, wherein said heat transfer medium in said dipped type heat exchanger is aqueous cooling agent.

5. The vapor compressed air conditioning or refrigeration equipment in accordance with claim 1, wherein the improvement further comprises:

a pressure accumulator disposed at the high pressure side of said compressor and connected between said compressor and said condenser via refrigerant pipes; and flow rate control means provided within condenser tubes of said condenser or outside condenser tubes of said condenser so as to maintain high pressure side refrigerant at high pressure.

6. The vapor compressed air conditioning or refrigeration equipment in accordance with claim 5, wherein said heat transfer medium in said dipped type heat exchanger is water.

7. The vapor compressed air conditioning or refrigeration equipment in accordance with claim 6, wherein said water is condensed water of said air conditioning or refrigeration equipment.

8. The vapor compressed air conditioning or refrigeration equipment in accordance with claim 5, wherein said heat transfer medium in said dipped type heat exchanger is aqueous cooling agent.

* * * * *